United States Patent [19]

Vanasse

[11] Patent Number: 4,709,851

[45] Date of Patent: Dec. 1, 1987

[54] PACKAGE FOR LOAF OF BREAD

[75] Inventor: Robert W. Vanasse, Overland Park, Kans.

[73] Assignee: Interstate Brands Corporation, Kansas City, Mo.

[21] Appl. No.: 15,790

[22] Filed: Feb. 17, 1987

Related U.S. Application Data

[63] Continuation of Ser. No. 882,429, Jul. 7, 1986, abandoned, which is a continuation of Ser. No. 680,133, Dec. 10, 1984, abandoned.

[51] Int. Cl.[4] ..... B65D 33/02

[52] U.S. Cl. ..... 229/87 B; 383/111; 383/119; 426/128

[58] Field of Search ..... 229/87 B; 383/111, 119; 426/115, 124, 128; 206/45.33, 804, 817; 221/255

[56] References Cited

U.S. PATENT DOCUMENTS

| | | | |
|---|---|---|---|
| 1,857,722 | 5/1932 | Howell | 229/87 B |
| 1,896,601 | 2/1933 | Andrews | 229/87 B |
| 1,989,944 | 2/1935 | Quigg | 206/45.33 |
| 2,245,064 | 6/1941 | Bemiss | 426/128 |
| 2,429,191 | 10/1947 | Olsen | 206/526 |
| 2,588,409 | 3/1952 | Olsen | 206/526 |
| 3,013,886 | 12/1961 | Lowe | 426/115 |
| 3,083,107 | 3/1963 | Tindall | 426/115 |
| 3,096,014 | 7/1963 | Swan | 229/87 B |
| 3,146,111 | 8/1964 | Enoch | 426/128 |
| 3,182,893 | 5/1965 | Bremkamp | 229/87 B |
| 3,317,326 | 5/1967 | Peters | 426/396 |
| 3,355,303 | 11/1967 | Meyers | 229/87 B |
| 3,428,240 | 2/1969 | Morris | 229/87 B |
| 4,266,668 | 5/1981 | Paek | 426/128 |

*Primary Examiner*—Stephen P. Garbe

*Attorney, Agent, or Firm*—Schmidt, Johnson, Hovey & Williams

[57] ABSTRACT

A package for a loaf of bread comprising a flexible, conventional plastic bag which encloses a loaf of bread and a U-shaped support member of cardboard material within the bag and embracing the loaf of bread. The support member presents a base wall which normally underlies the bottom of the loaf and a pair of opposed end flaps attached to the base wall and extending normally vertically therefrom whereby the support member is generally U-shaped in configuration to embrace the loaf of bread therewithin. The end flaps are each adjacent a corresponding end of the plastic bag and it is desirable that one end of the bag be of a transparent material whereby the outer surface of the end flap of the support member adjacent the transparent end of the bag may be viewed through said transparent end and any indicia which might be placed on the outer surface of said end flap be read through the end of the bag. The end flaps are each of a height and width substantially coincident with the height and width of the adjacent end of the loaf of bread and the base wall is coextensive in length and substantially coextensive in width with the loaf of bread, all to the end that the loaf of bread is supported by and embraced within the support member. The support member may be utilized to withdraw the loaf of bread and the member from the bag after the closure end of the bag has been opened or, in the alternative, the support member may be withdrawn after the closure end of the bag has been opened and therethrough, by grasping and quickly jerking the adjacent end flap of the support member, whereby to pull the support member through the opened end of the bag.

1 Claim, 4 Drawing Figures

PACKAGE FOR LOAF OF BREAD

This is a continuation of application Ser. No. 06/882,429, filed 07/07/86, which was a continuation of Ser. No. 06/680,133, filed 12/10/84, both now abandoned.

BACKGROUND OF THE INVENTION

1. Field of the Invention

It has long been known to package a loaf of bread, either sliced or unsliced, within a bag of plastic material, which bag is flexible in nature and surrounds the loaf of bread, the bag having a gusset end which is the sealed end and a closure end, which is the end which has a suitable tie thereon whereby to close the same and present what is called a "pony-tail" end of the bag enclosing the loaf of bread.

The conventional plastic bag enclosure for a loaf of bread is not satisfactory, particularly during handling, storage and display of the loaf of bread inasmuch as it permits compression of the bread both longitudinally and transversely. Yet further, the bread may not be stacked when transported or stored since the bag affords no protection against the compression of the lowermost loaves when several loaves are stacked one atop another.

This invention overcomes the aforementioned disadvantages inherent in the bag packaging of bread by providing a support member for the loaf of bread which support member embraces the loaf of bread and is contained within the bag together with the loaf of bread. The support member is of a cardboard material whereby to give the overall package for the loaf of bread a certain amount of rigidity, which rigidity prevents longitudinal or transverse compression of the loaf of bread during shipment, storage, display and handling.

Yet further, the support member permits the utilization of portions thereof for advertising or informative indicia which may be viewed through the gusset end of the bag, when the gusset end of the bag is made of transparent material.

All of the foregoing permits maintenance of the form of the loaf of bread during handling, storage and display which makes the same more attractive to the consumer.

2. Background of the Invention

This invention is an improvement, as indicated above, upon conventional flexible bag packaging for loaves of bread in that it provides a package which imparts a degree of rigidity to the overall package, which package includes the loaf of bread, the support member and the bag, the support member having a base wall which underlies the loaf of bread when it is in its normally horizontal position and end flaps which are vertical with respect to the base wall and whereby the U-shaped support member embraces the loaf of bread.

The packaging described herein was developed to overcome the disadvantages inherent in the packaging of a loaf of bread in merely a flexible plastic bag.

SUMMARY OF THE INVENTION

The invention comprises a composite package for a loaf of bread, which package includes a flexible bag which encloses the loaf of bread and a support member within the bag which embraces the loaf of bread, there being a base wall for the support member and a pair of opposed end flaps whereby to give the member a U-shaped configuration, the loaf of bread being seated within and embraced by the support member. The base wall normally underlies the loaf of bread and the end flaps are each proximal to a respective opposed end of the loaf of bread. The bag normally has a gusset end and a closure end and each of the end flaps is adjacent a corresponding end of the bag, the outer surface of each end flap being visible if the end of the bag adjacent thereto is transparent, which may be provided in the fabrication of the bag. Thus, indicia placed on the outer surface of an end flap would be visible through the corresponding end of the bag.

The base wall is coextensive in length with the loaf of bread and substantially coextensive in width therewith whereby to provide a support member which wholly underlies the loaf of bread. The end flaps are substantially coincident in height and width with the height and width of the respective adjacent ends of the loaf of bread whereby to add to the overall support for the bread and to provide a framework for support of the bag which it is brought over the loaf of bread which loaf of bread is supported within the member, as described above.

The support member and the loaf of bread may be collectively removed together from the bag by opening the closure end of the bag and slowly pulling the adjacent end flap whereby to telescope the support member and loaf of bread outwardly from the bag.

On the other hand, if it is desired to merely remove the support member, the closure end of the bag may be opened and the adjacent end flap grasped and quickly jerked whereby the opposite end flap will fall away from the corresponding end of the loaf of bread and is moved to a flat condition, in horizontal alignment with the base wall, as the entire support member is pulled out of the opened bag.

DETAILED DESCRIPTION

Figure 3:
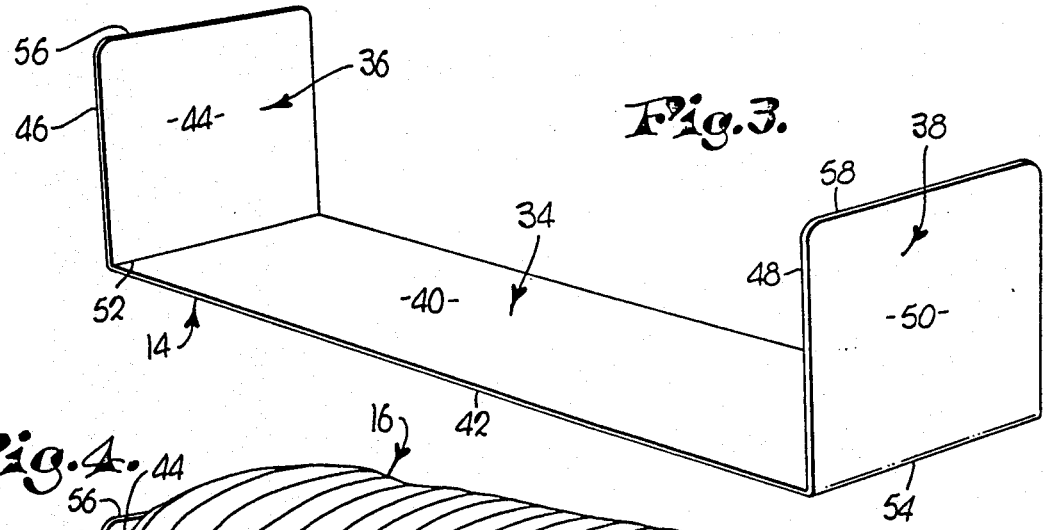
FIG. 3 is a perspective view of the support member alone.

The package for a loaf of bread is broadly designated by the numeral 10 and includes as its general components, a flexible, normally plastic bag 12 and a generally U-shaped support member 14. These elements, when combined, constitute an effective package for a loaf of bread such as 16, which loaf of bread may be sliced or unsliced and may be of any length or width, the support member 14 and bag 12 being sized to accommodate the loaf of bread to be packaged therewithin.

The bag 12 is of conventional construction and configuration and is of the type which has heretofore been widely used in the packaging of loaves of bread. The bag presents, when it is in position enclosing the loaf of bread 16 and the support member 14, a top wall 18, a bottom wall 20, side walls 22 and 24; a closure end wall 26 and a gusset end wall 28.

The bag 12 may be fabricated from any suitable material, as is known, which material is normally a relatively thin, highly flexible plastic material adapted for use in bread packaging machines and whereby the bread, in loaf form, is inserted into the bag through the closure end 26 thereof by machinery which will suitably telescope the loaf of bread 16 into the bag 12 when the closure end 26 of the bag is held open.

It is desirable, in the invention herein described, that either one or both of the end walls of the bag 12 be transparent in nature. Preferably the gusset end wall 28 will be transparent for viewing therethrough inasmuch as the closure end wall 26 prevents clear viewing as said end wall is normally pinched together as by a closure tie 30 whereby to present what is called in the trade the "pony-tail" end 32 and of the bread package.

When multiple loaves of bread are arranged on shelves for display purposes in stores, it is desirable to place the gusset end of the bag toward the consumer so that the end of the loaf may be viewed and indicia printed on the gusset end wall 28 of the bag may be fully and easily read by the consumer, inasmuch as indicia which might be imprinted on closure end wall 26 is not readily readable due to the gathering of the end wall 26 by tie 30 into pony-tail 32. Accordingly, it is preferable that the gusset end wall 28 of the bag of this package 10 be transparent whereby indicia may be viewed therethrough.

Figure 4:
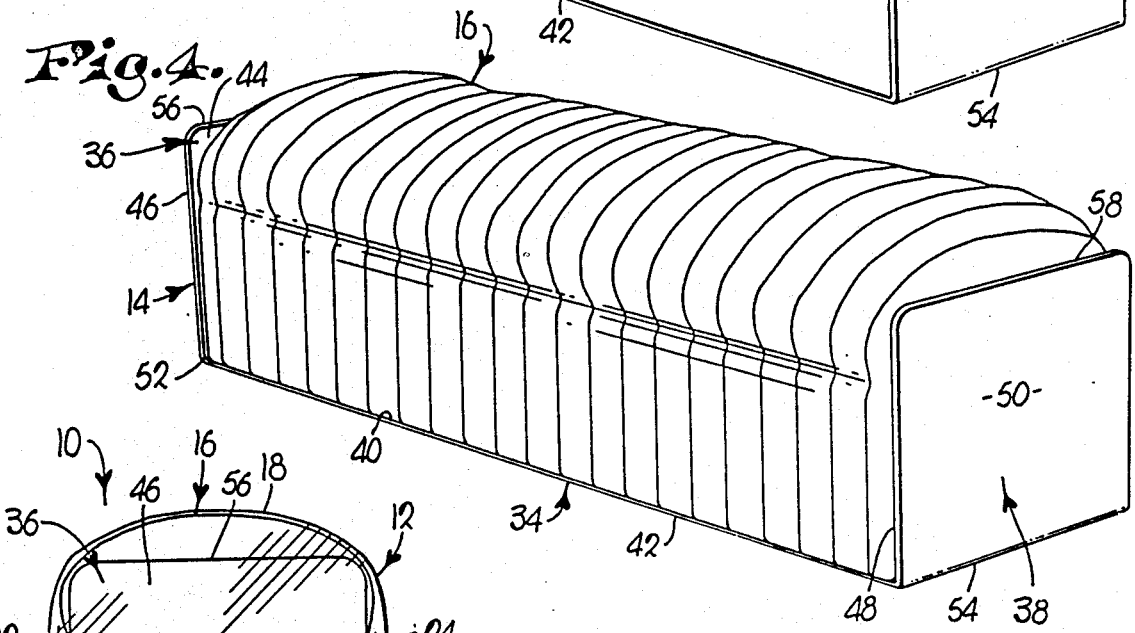
FIG. 4 is a perspective view of the loaf of bread embraced by and seated within the support member.
Figure 2:
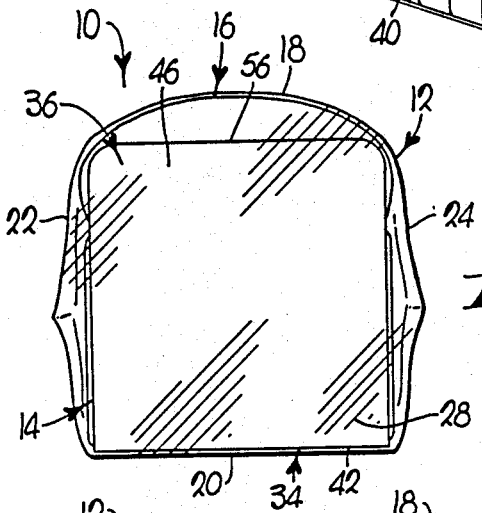
FIG. 2 is an end elevational view of the gusset end of the package for the loaf of bread.
Figure 1:
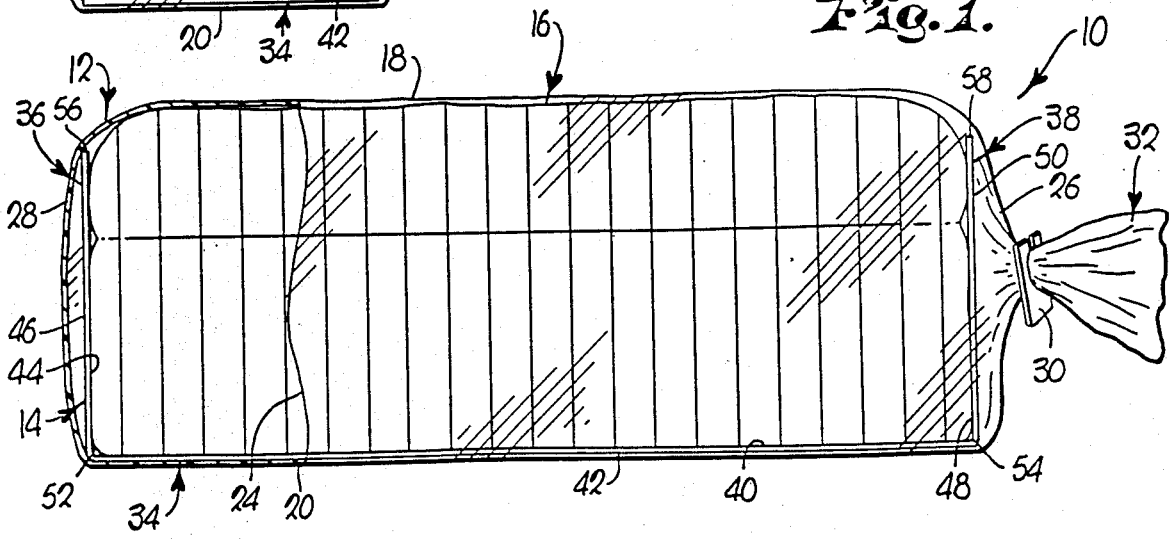
FIG. 1 is a side elevational view of the package for the loaf of bread, a portion of the bag being broken away and in section to reveal details of construction.

The support member 14 is intended to be received within the bag 12 with the loaf of bread 16 seated therewithin and embraced thereby as is best shown in FIGS. 4 and 1 for instance, FIG. 4 showing the bread, in sliced loaf form, seated within the support member 14 and FIG. 1 showing the bread, in sliced loaf form and seated within the support member 14 positioned within the bag 12 whereby to create the composite package 10 which would be the package seen and selected by the consumer at the store.

The support member 14 is fabricated from a suitable cardboard material, normally a coated cardboard which is approved for use with and contact with food products.

The support member 14 presents a base wall 34 and a pair of opposed, upstanding end flaps 36 and 38, respectively, which are positioned at the ends of the base wall 34 as clearly illustrated in FIG. 4 of the drawing whereby the support member 14 assumes a U-shaped overall configuration.

The base wall 34 has a top surface 40 and a bottom surface 42. End wall 36 has an inner surface 44 and an outer surface 46. Likewise, the end flap 38 has an inner surface 48 and an outer surface 50. Each of the end flaps is joined to its proximal end of the base wall 34 by a corresponding fold line, this being 52 in the case of end flap 36 and 54 in the case of end flap 38. It will be appreciated that the fold lines may be perforated suitably to permit the ready swinging movement of the end flaps 36 and 38 with respect to base wall 34 for purposes which will hereinafter become apparent. Such perforations could be in the form of individually aligned holes or a series of elongated slots, as is conventional, but are not shown in the drawing.

In creating the composite package 10 for the loaf of bread 16, the support member 14 is positioned beneath the loaf of bread, it being noted that it is conventional for the curved surface of the loaf of bread to be normally uppermost and for the flat surface thereof to be normally lowermost. Suitable packaging machinery has been developed which permits the placement of the loaf of bread 16 within the support member 14 prior to that unit, such as shown in FIG. 4, being inserted within the bag 12.

It is notable that the base wall 34 is coextensive in length with the loaf of bread 16 but is designed to just accommodate the loaf, depending upon the particular length of the loaf of bread and that the base wall is of substantially the same width as the loaf of bread whereby the loaf rests in substantially overlying relationship to the top surface 40 of the base wall 34 of the support member 14, as illustrated.

Likewise, it is desirable that the end flaps 36 and 38 be substantially coincident in height and width with the adjacent ends of the loaf of bread whereby to protect the ends from compression and to give support to the overlying ends 26 and 28 of the bag 12.

Once the loaf of bread 16 has been seated within and is embraced by the support member 14, it may then be inserted within the bag 12 as by opening the closure end 26 of the bag 12 and telescoping the loaf of bread, as borne upon the support member 14 into the bag, whereupon the bag is closed and sealed as by the closure tie 30, whereby to present pony-tail 32.

As indicated above, it is desirable that the gusset end 28 of the bag 12 be transparent whereby indicia may be printed upon the outer surface 46 of the end flap 36. This permits the gusset end wall of the package 10 to be positioned in a display rack toward the customer whereby the customer may read the indicia upon the outer surface 46 of end wall 36.

Such indicia, while not shown in the drawing, may be in the form of the brand name of the bread, advertising material or other customer attracting information or identification. Preferably, the bread in the package 10 will be stacked upon racks whereby the indicia on end wall 46 is readily visible to the consumer whereby it may achieve its desired purpose of communication with the potential customer.

It will also be appreciated that the presence of the cardboard support member 14 gives overall rigidity to the composite package 10 inasmuch as it supports the bottom of the loaf of bread and, as will be appreciated, prevents longitudinal compression or squashing of the loaf of bread during storage, transportation, handling and display. This for the reason that the compressive forces are moved against the end flaps 36 and 38, compression of the loaf of bread 16 as positioned between the end flaps will be resisted by the rigidity of the base wall 34.

Likewise, since end flaps 36 and 38 are substantially coincident in size with the ends of the loaf of bread, transverse forces at the ends of the loaf will be resisted and it will be difficult to transversely compress the loaf of bread during handling, storage or display.

Also, the rigidity of the support member 14 permits stacking of a plurality of loaves of bread inasmuch as the end walls 36 and 38 tend to support, by the uppermost edges 56 and 58 thereof, respectively, the next above loaf of bread, particularly if such loaf is likewise in the package 10 hereinabove described.

Once the package of bread has been purchased by the consumer, the closure end wall 26 may be opened, as by removing closure tie 30, and the pony-tail 32 spread apart whereby access is gained for instance to end flap 38 of the support member as shown in FIG. 1 for instance.

If it is desired to remove the entire support member 14, together with the loaf of bread 16, collectively and together, the end flap 38 may be grasped and slowly pulled outwardly of the closure end of the bag whereby to telescope the support member 14 and loaf of bread 16 from within the bag 12.

On the other hand, if it is desired to remove only the support member 14, here again the closure end may be opened, as described, and end flap 38 grasped, preferably adjacent upper edge 58 thereof and quickly jerked through the open end of the bag whereupon the opposite end flap 36 will swing downwardly, away from the end of the loaf of bread and within the bag 12, all to the end that the flap 36 will longitudinally align with the base wall 34 permitting the entire support member to be slipped from beneath the loaf of bread and out of the open end of the bag 12.

Thus, there is provided a composite package for a loaf of bread which has the several advantages hereinabove referred to, from a structural standpoint and which also presents marketing advantages inasmuch as the package may be utilized to communicate to the consumer through indicia which is carried by the support member.

I claim:

1. A bread package comprising:

an elongated loaf of bread presenting a bottom surface, a pair of spaced apart upstanding heel surfaces, elongated upstanding sidewall surfaces, and an upper surface;

an elongated, U-shaped, lightweight cardboard support member for said loaf of bread, said member having an elongated bottom panel in direct contact with said bottom surface of the loaf of bread, and a pair of marginal, upstanding end flaps respectively in direct engagement with corresponding heel surfaces of the bread loaf, there being respective transverse lines of weakness operably connecting each of said flaps to said bottom panel for swinging movement thereof with respect to the bottom panel and away from the adjacent heel surface, each of said flaps being of a height and a width to be substantially coincident with the height and width of the corresponding adjacent heel surface; and an elongated flexible bag completely enclosing said loaf of bread and support therefor in a closely conforming relationship about the entire outer surface presented by the bread loaf and support, said upright end flaps, and the closely conforming portions of said bag, cooperatively serving to prevent undue compression of said bread loaf in the event that additional bread packages are placed atop said bread package, said U-shaped support member having sufficient rigidity and structural integrity in relation to said closely conforming bag and said loaf of bread for removal of the bread loaf bodily from said bag by grasping one of said flaps and slowly pulling both the support member and the bread loaf from the bag, the lightweight cardboard material making up said flaps, and said respective lines of weakness, imparting sufficient flexibility to said support member in relation to said closely conforming bag and said loaf of bread for removal of the support member from said bag while leaving said bread loaf within the confines of the bag, by grasping one of said flaps and quickly jerking the support from the bag, said U-shaped support member and bag being the sole support means for maintaining said loaf in its desired position within said package.

* * * * *